United States Patent [19]

Shono

[11] 4,297,181

[45] Oct. 27, 1981

[54] PROCESS FOR PREPARING KETONES

[76] Inventor: Tatsuya Shono, 13, Ichikawacho 1-chome, Kamitakano, Sakyo-ku, Kyoto-shi, Kyoto 606, Japan

[21] Appl. No.: 198,958

[22] PCT Filed: Oct. 11, 1979

[86] PCT No.: PCT/JP79/00257

§ 371 Date: Jun. 11, 1980

§ 102(e) Date: Jun. 11, 1980

[87] PCT Pub. No.: WO80/00714

PCT Pub. Date: Apr. 17, 1980

[30] Foreign Application Priority Data

Oct. 11, 1978 [JP] Japan ..... 53-125406

[51] Int. Cl.[3] ..... C25B 3/02

[52] U.S. Cl. ..... 204/78

[58] Field of Search ..... 204/78

[56] References Cited

PUBLICATIONS

J.A.C.S., 92 (9), pp. 2821–2825 (1970).

Tetrahedron Letters, 1968, No. 15, pp. 1831–1835.

J.C.S. (c), pp. 676–678 (1970).

*Primary Examiner*—R. L. Andrews

*Attorney, Agent, or Firm*—Armstrong, Nikaido, Marmelstein & Kubovcik

[57] ABSTRACT

Process for preparing a ketone by subjecting a secondary alcohol to a catalytic electrode oxidation in the presence of iodine or/and an iodine compound.

6 Claims, No Drawings

PROCESS FOR PREPARING KETONES

TECHNICAL FIELD

This invention relates to a process for preparing ketones.

BACKGROUND ART

Oxidation of alcohols is widely utilized in processes for preparing ketones. Conventionally known processes are those in which oxidizing agents of the manganese or chrome type are used, those which comprise oxidation with nitric acid or halogen, those which comprise oxidation by oxygen with use of catalyst, etc. These conventional processes have many drawbacks of involving vigorous reaction, of producing large amounts of by-products or of causing environmental pollution.

Accordingly it is strongly desired to provide a process for preparing ketones from alcohols in high yields by a simple and safe operation.

DISCLOSURE OF INVENTION

This invention provides a process for preparing a ketone, characterized in that a secondary alcohol is subjected to catalytic electrode oxidation in the presence of iodine and/or an iodine compound.

The process of the invention is completely novel and resembles none of those of the prior art. We have found that the reactions involving iodine and electrolysis used in the present invention are disclosed only in the following three references. These reactions are entirely different from the present invention. Stated more specifically, in the reactions described below, iodine is stoichiometrically consumed while in the catalytic electrode oxidation according to the invention iodine or the iodine compound remains unconsumed and the reaction is apparently effected by the electric energy. Thus the present invention provides an epoch-making reaction entirely different in the reaction mechanism from the conventional processes. The reaction according to the invention is featured by being widely applicable. The conventional reactions are as follows.

(a) J.A.C.S. 92, 2821 (1970)

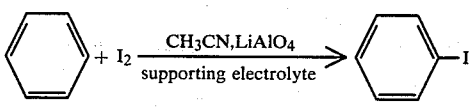

(Yield:11%)

(b) Tetrahedron Letter 1968, 1831

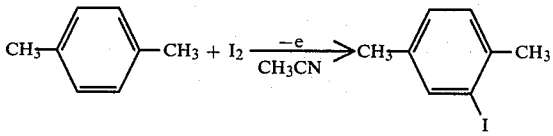

(c) J.C.S. 676 (1970)

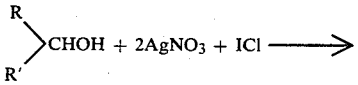

-continued

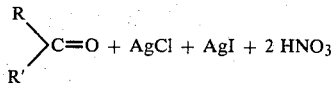

Presumably the reaction mechanism of the catalytic electrode oxidation according to the invention is as follows.

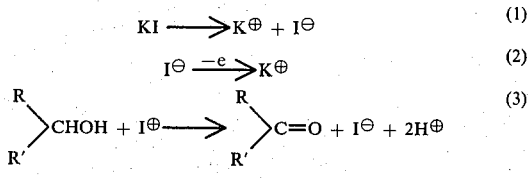

The iodine anion formed according to the scheme (3) is oxidized to an iodine cation according to the scheme (2) and recycled. As apparent from the reactions mechanism, iodine anion is utilized as recycled due to the presence of a small amount of iodine or/and an iodine compound, and is left unconsumed.

In the present invention secondary alcohols useful as the starting material are not particularly limited, but an extremely wide variety of alcohols are usable. Especially, even the materials which would decompose or cause side reactions in the conventional oxidation reactions, can readily give the desired products in high yields under the mild reaction conditions according to the invention.

Secondary alcohols useful in the invention include almost all secondary alcohols. Typical of the secondary alcohols are, for example, the following compounds represented by the formula

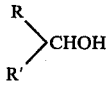

wherein R and R′ are the same or different and represent an aliphatic group, an alicyclic group, an aromatic group or a heterocyclic group. Examples of such groups are an alkyl group, an alkenyl group, an alkynyl group, a cycloalkyl group, a cycloalkenyl group, an aryl group, an aralkyl group, which have 1 to 100 carbon atoms, including those groups containing therein at least one heteroatom such as N,O,S,P or the like and almost all of other organic residues.

The reaction according to the invention is carried out in the presence of iodine or/and an iodine compound. Examples of the iodine compound are iodine compounds of hydrogen, lithium, sodium, potassium, cesium, magnesium, zinc, calcium, cobalt, cadmium, iron, nickel, barium, manganese, etc. The amount of iodine or the iodine compound is not critical, but generally about 0.01 to about 0.5 mole per mole of the starting alcohol is satisfactory.

In the present invention, all of usual electrodes as of platinum, carbon, iron, stainless steel, lead, mercury, etc. are usable as the electrode. Also usable are those of conductive metal oxides such as titanium oxide, metal-plated and metal-evaporated electrodes, etc. Diaphragms may optionally be used. When the diaphragm is used, it is natural to carry out the reaction in the anodic cell.

One of the features of the invention is that the reaction proceeds at room temperature. However the reaction may be conducted below room temperature or with heating. The electrolysis may be either constant-current electrolysis or potentiostatic electrolysis.

In the present invention when the secondary alcohols which are low in solubility in water or are solid at temperatures within the reaction temperature range are used as the starting material, the catalytic electrode oxidation can be conducted by using, as a solvent, a tertiary alcohol or a solvent partly soluble in water, or in a two-layer system comprising an aqueous layer and an organic layer, the aqueous layer containing iodine or/and the iodine compound, thereby readily giving ketones in high yields. Examples of the solvents are tertiary alcohols such as t-butanol, etc., saturated hydrocarbons such as n-hexane, cyclo-hexane, etc., aromatic compounds such as benzene, toluene, etc., ethers such as ethyl ether, THF, etc., and like inert solvents.

When the reaction product i.e. a ketone is further subject to electrode oxidation or reduction and unstable, the reaction conducted in the two-layer system can give the desired product in high yields since the product formed continuously transfers to the organic layer. Of course, the reaction can be carried out in a uniform system according to the present invention. The process of the invention is practiced by a simple and safe operation merely by using iodine or the iodine compound, serving as a catalyst, and the alcohol as a starting material, gives only small amounts of by-products and is free from environmental pollution. Since the reaction of the invention can be conducted under the mild reaction conditions at room temperature and atmospheric pressure, the present invention assures savings in natural resources and energy. Furthermore the products can be separated easily.

As stated above, the present invention has many advantages, is very widely applicable and provides a completely new art.

The present invention will be described below with reference to Examples.

EXAMPLE 1

To a 2M solution (10 ml) of lithium iodide is added 10.9 g of phenylethylcarbinol, and to the mixture are added 5 ml of t-butanol and 15 ml of hexane, serving as a solvent. Into the resulting two-layer system, platinum electrodes are placed and the constant-current electrolysis is carried out at 0.5 A for 50 hours while cooling the system from the bottom. After the reaction, the organic layer is separated, and the aqueous layer is extracted with ether. The organic layer and ether extract are combined, dried and distilled to give the contemplated phenylethylketone. Yield: 93%. Boiling point: 108° C./20 mmHg.

IR: ($cm^{-1}$( 1690, 750, 3040, 690.

NMR: (ppm) 1.20 (t,3H), 2.95 (q,2H), 7.45 (m,3H), 7.90 (m,2H).

EXAMPLE 2

To a 1M aqueous solution (10 ml) of potassium iodide is added 10.0 g of cyclohexanol. Carbon electrodes are placed in the mixture and the constant-current electrolysis is effected without using a diaphragm. The reaction system is maintained at 25° C. while externally cooling the system. After electrolysis at 0.5 A for 40 hours, the organic layer is separated and the aqueous layer is extracted with ether. The organic layer and ether extract are combined and distilled, giving cyclohexanone. Yield: 89%. Boiling point: 156° C.

IR: ($cm^{-1}$) 1715.

NMR: (ppm) 1.85 (m,6H), 2.38 (m,4H).

EXAMPLE 3

To a 1 M aqueous solution (10 ml) of potassium iodide is added 13.0 g of 2-octanol and to the mixture is added 1 ml of t-butanol as a solvent. Platinium electrodes are placed therein and the electrolysis is effected at 1.0 A for 15 hours. After the reaction, the reaction mixture is extracted with ether and the extract is dried and distilled to give the desired 2-octanone. Yield: 99%. Boiling point: 85° C./20 mmHg.

IR: ($cm^{-1}$) 1715.

NMR: (ppm) 0.9 (t,3H), 1.0 to 1.8 (m,8H), 2.2 to 2.6 (t,3H), 2.15 (s,3H).

EXAMPLE 4

Contemplated ketones are prepared in the same manner as in Example 2 except that the starting alcohols listed in Table 1 are used. Table 1 shows the results.

TABLE 1

| Alcohol | Product | Boiling point (°C.) | Yield (%) |
|---|---|---|---|
| Cyclo-dodecanol | Cyclo-dodecanone | 125° C./12 mmHg | 94% |
| Borneol | Camphor | m.p. 179° C. | 93% |
| Cyclooctanol | Cyclooctanone | 90° C./22 mmHg | 97% |
| 2-Butanol | Methylethyl-ketone | 79.5° C. | 99% |
| o-Methylcyclo-hexanol | o-Methylcyclo-hexanone | 170° C./740 mmHg | 90% |
| Methylvinyl-carbinol | Methylvinyl-ketone | 81° C. | 87% |
| Phenylmethyl-carbinol | Acetophenone | 192° C./730 mmHg | 95% |
| l-Menthol | l-Menthone | 201° C./730 mmHg | 92% |
| Cyclopentanol | Cyclopentanone | 28° C./16 mmHg | 98% |
| Isopropanol | Acetone | 56.5° C. | 98% |

I claim:

1. Process for preparing a ketone, characterized in that a secondary alcohol is subjected to a catalytic electrode oxidation in the presence of iodine or/and an iodine compound.

2. Process for preparing a ketone as defined in claim 1 wherein the catalytic electrode oxidation is carried out in a uniform reaction system.

3. Process for preparing a ketone as defined in claim 1 wherein the catalytic electrode oxidation is carried out in a two-layer reaction system comprising an aqueous layer and an organic layer.

4. Process for preparing a ketone as defined in claim 1 wherein the iodine compound is an iodine compound of hydrogen, lithium, sodium, potassium, cesium, magnesium, zinc, calcium, cobalt, cadmium, iron, nickel, barium, or manganese.

5. Process for preparing a ketone as defined in claim 1 wherein the secondary alcohol is an alcohol of the general formula

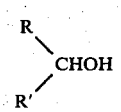

wherein R and R' are the same or different and represent an aliphatic group, an alicyclic group, an aromatic group or a heterocyclic group.

6. Process according to claim 5 wherein the groups R and $R^1$ contain a hetero atom selected from the group consisting of N, O, S, and P.

* * * * *